US009089187B2

(12) United States Patent
Takano et al.

(10) Patent No.: US 9,089,187 B2
(45) Date of Patent: Jul. 28, 2015

(54) FASTENER STRINGER FOR CONCEALED SLIDE FASTENER

(75) Inventors: Akira Takano, Toyama (JP); Takayuki Hasegawa, Toyama (JP); Masashi Doi, Toyama (JP)

(73) Assignee: YKK Corporation (JP)

( * ) Notice: Subject to any disclaimer, the term of this patent is extended or adjusted under 35 U.S.C. 154(b) by 490 days.

(21) Appl. No.: 13/394,830

(22) PCT Filed: Sep. 11, 2009

(86) PCT No.: PCT/JP2009/065915

§ 371 (c)(1),
(2), (4) Date: Mar. 8, 2012

(87) PCT Pub. No.: WO2011/030442

PCT Pub. Date: Mar. 17, 2011

(65) Prior Publication Data

US 2012/0167355 A1 Jul. 5, 2012

(51) Int. Cl.

| | |
|---|---|
| ***A44B 19/24*** | (2006.01) |
| ***A44B 19/08*** | (2006.01) |
| ***A44B 19/34*** | (2006.01) |
| ***D03D 3/02*** | (2006.01) |

(52) U.S. Cl.
CPC ..... *A44B 19/08* (2013.01); *A44B 19/346* (2013.01); *D03D 3/02* (2013.01); *Y10T 24/2591* (2015.01)

(58) Field of Classification Search
CPC ..... A44B 19/12; A44B 19/343; A44B 19/406
USPC ..... 24/391, 393, 394, 395, 396, 432
See application file for complete search history.

(56) References Cited

U.S. PATENT DOCUMENTS

| | | | | |
|---|---|---|---|---|
| 3,143,778 | A * | 8/1964 | Abraham | 24/432 |
| 3,343,234 | A | 9/1967 | Chery | |
| 3,505,710 | A * | 4/1970 | Frohlich | 24/393 |
| 3,594,874 | A | 7/1971 | Fujisaki | |

(Continued)

FOREIGN PATENT DOCUMENTS

| | | | |
|---|---|---|---|
| DE | 1908068 | A | 9/1970 |
| DE | 1908069 | A | 11/1970 |

(Continued)

OTHER PUBLICATIONS

International Search Report and Written Opinion, PCT International Application No. PCT/JP2009/065915, mailed Dec. 15, 2009.

*Primary Examiner* — Victor Batson
*Assistant Examiner* — Jason W San
(74) *Attorney, Agent, or Firm* — Kilpatrick Townsend & Stockton LLP

(57) ABSTRACT

The invention provides a fastener stringer for a concealed slide fastener in which right and left fastener tapes respectively include a tape body portion, a tape bend portion bent into a U-shape and an element mounting portion, a hollow weave portion is formed at each fastener tape, and a film body is accommodated in the hollow weave portion in a state of being sewn together with a fastener element as one side edge thereof being located to the tape bend portion side from a sewing thread. Accordingly, since stiffness of the hollow weave portion is improved by the film body, a closely-contacted state between the right and left tape bend portions is stably maintained and concealing characteristics of the concealed slide fastener can be improved.

11 Claims, 7 Drawing Sheets

(56) References Cited

U.S. PATENT DOCUMENTS

| | | | | | |
|---|---|---|---|---|---|
| 3,795,950 | A * | 3/1974 | Sohr | 24/395 |
| 4,058,145 | A * | 11/1977 | Frohlich et al. | 139/384 B |
| 4,100,656 | A * | 7/1978 | Moertel | 24/398 |
| 4,143,680 | A * | 3/1979 | Murai et al. | 139/384 B |
| 4,718,149 | A * | 1/1988 | Tsubokawa | 24/392 |
| 5,129,127 | A * | 7/1992 | Hamatani | 24/394 |
| 5,386,616 | A * | 2/1995 | Norvell | 24/389 |
| 6,427,294 | B1 * | 8/2002 | Shibaike et al. | 24/398 |
| 6,877,192 | B2 * | 4/2005 | Tominaga et al. | 24/381 |
| 7,257,868 | B2 * | 8/2007 | Yoneshima | 24/415 |
| 7,293,434 | B2 * | 11/2007 | Ikeguchi et al. | 66/193 |
| 7,520,304 | B2 * | 4/2009 | Shimono et al. | 139/384 B |
| 8,397,353 | B2 * | 3/2013 | Chou | 24/391 |
| 8,667,652 | B2 * | 3/2014 | Thomas et al. | 24/389 |
| 8,739,372 | B2 * | 6/2014 | Hasegawa et al. | 24/393 |
| 2005/0235466 | A1 * | 10/2005 | Segawa et al. | 24/396 |
| 2010/0125982 | A1 * | 5/2010 | Chou | 24/397 |

FOREIGN PATENT DOCUMENTS

| | | | | |
|---|---|---|---|---|
| FR | 1536852 | A | 3/1970 | |
| FR | 2932343 | A | 11/1970 | |
| GB | 1177727 | A | 1/1970 | |
| GB | 1299316 | A | 12/1972 | |
| JP | 49-44246 | B1 | 11/1974 | |
| JP | 51-4826 | Y1 | 2/1976 | |
| JP | S63-33808 | | 3/1988 | |
| JP | H3-101299 | | 10/1991 | |
| WO | WO 2004000061 | A1 * | 12/2003 | A44B 19/44 |

* cited by examiner

FASTENER STRINGER FOR CONCEALED SLIDE FASTENER

This application is a national stage application of PCT/JP2009/065915, which is incorporated herein by reference.

TECHNICAL FIELD

The invention relates to a fastener stringer for a concealed slide fastener having superior concealing characteristics capable of concealing coupled right and left fastener elements not to be viewable from a stringer exposure face side exposed to the outside of the fastener stringer when right and left element rows are coupled.

BACKGROUND ART

In general, slide fasteners are roughly classified into two representative types which are a slide fastener of a normal type in which coupled right and left element rows are exposed as being disposed at a tape top face side of fastener tapes and a slide fastener of a concealed type (i.e., a so-called concealed slide fastener) capable of concealing coupled right and left element rows not to be viewable from the outside. Such a concealed slide fastener is preferably used for products such as various clothing and shoes, and recently, has been used for products such as seat covers for seats of automobiles or trains as taking advantage not to worsen product design owing to the concealing characteristics.

An example of such a concealed slide fastener is disclosed in Japanese Utility Model Application Publication No. 51-4826 (Patent Document 1).

A concealed slide fastener 80 disclosed in Patent Document 1 includes a right-and-left pair of fastener stringers 81 and a slider 82 capable of opening and closing the right and left fastener stringers 81, as illustrated in FIG. 13.

Each fastener stringer 81 of the right and left includes a woven fastener tape 83 and a continuously-shaped fastener element 84 which is sewn to the fastener tape 83. Each fastener tape 83 includes a tape body portion 83*a*, a tape bend portion 83*b* bent into a U-shape as extending from one side edge of the tape body portion 83*a* in the tape width direction, and an element mounting portion 83*c* to which a fastener element is sewn as further extending from the tape bend portion 83*b*. Further, a hardened portion 83*d* hardened by being impregnated with synthetic resin liquid is disposed to the element mounting portion 83*c* and a part of the tape bend portion 83*b* at the element mounting portion 83*c* side.

The fastener element 84 includes a coupling head 84*a*, upper and lower leg portions 84*b*, 84*c* extending from the coupling head 84*a*, and a connecting portion 84*d* which connects the mutually adjacent fastener elements 84. Further, a recess 84*e* to which the fastener tape 83 is inserted is formed at the upper face of the upper leg portion 84*b* which is contacted to the fastener tape 83.

In the concealed slide fastener 80 of Patent Document 1, the fastener element 84 is sewn to the hardened element mounting portion 83*c* of the fastener tape 83 with a sewing thread 85 in a state that the hardened portion 83*d* of the fastener tape 83 is fitted to the recess 84*e* which is formed at the fastener element 84.

According to the concealed slide fastener 80 of Patent Document 1, since the element mounting portion 83*c* and a part of the tape bend portion 83*b* of the fastener tape 83 are hardened, a closely-contacted state between the tape bend portions 83*b* of the right and left fastener tapes 83 can be stably maintained when the right and left fastener elements 84 are coupled.

Accordingly, even if lateral tension force to laterally open the fastener tapes 83 is applied in a state that the right and left fastener elements 84 are coupled, for example, clearance-forming between the right and left tape bend portions 83*b* can be prevented by preventing the tape bend portions 83*b* which are closely contacted to each other from moving in a separating direction. Thus, the right and left fastener elements 84 in a coupled state can be stably concealed not to be viewable from an exposure face side of the concealed slide fastener 80.

Further, in Patent Document 1, a concealed slide fastener in which hardening is performed by fixing a synthetic-resin-made film body to one face (i.e., a tape outer face) of a partial area of a fastener tape instead of hardening a partial area by impregnating with synthetic resin liquid is disclosed as a modified example of the concealed slide fastener. It is possible to harden a partial area of a fastener tape also by fixing a synthetic-resin-made film body to the partial area of the fastener tape as described above. Thus, a closely-contacted state between the tape bend portions of the right and left fastener tapes can be stably maintained also by fixing the film body in a state that the right and left fastener elements are coupled. In this manner, the fastener elements can be stably concealed.

CITATION LIST

Patent Document

Patent Document 1: Japanese Utility Model Application Publication No. 51-4826

SUMMARY OF THE INVENTION

Problems to be Solved by the Invention

In the concealed slide fastener 80 disclosed in Patent Document 1, the element mounting portion 83*c* and a part of the tape bend portion 83*b* of the fastener tape 83 are impregnated with synthetic resin liquid and the tape area impregnated with the synthetic resin liquid is hardened, as described above. Further, in Patent Document 1, the fastener element 84 is sewn to the hardened element mounting portion 83*c* with the sewing thread 85.

However, when the element mounting portion 83*c* and a part of the tape bend portion 83*b* are hardened with synthetic resin liquid as in Patent Document 1, there have been problems that hand feeling of the concealed slide fastener 80 is worsened and that flexibility of the concealed slide fastener 80 in the tape longitudinal direction is impaired.

Further, when the element mounting portion 83*c* is entirely hardened with synthetic resin liquid as the concealed slide fastener 80, there also has been a problem that sewing of the fastener element 84 cannot be smoothly performed owing to difficulty to pierce the element mounting portion 83*c* with a sewing needle (i.e., a sewing-machine needle) when sewing the fastener element 84 to the element mounting portion 83*c*.

Meanwhile, in the concealed slide fastener disclosed as a modified example in Patent Document 1, hardening is performed by fixing the synthetic-resin-made film body to the tape outer face of the element mounting portion and a part of the tape outer face of the tape bend portion. Then, the fastener element is sewn with the sewing thread to the element mounting portion which is hardened with the film body.

In the concealed slide fastener in which the element mounting portion and the like are hardened by fixing the film body thereto as described above, positional shifting of the film body is apt to occur when the film body is fixed to the fastener tape. Since a predetermined place of the fastener tape is not stably hardened when the fixing position of the film body against the fastener tape is shifted, there has been a problem that concealing characteristics of the concealed slide fastener are impaired.

Further, in the concealed slide fastener according to the modified example, the fastener element is sewn to the element mounting portion to which the film body is fixed after the film body is fixed to the element mounting portion and the like of the fastener tape. With this structure, since the film body is fixed to the element mounting portion, a sewing needle (i.e., a sewing-machine needle) is required to pierce the element mounting portion and the film body to sew the fastener element to the element mounting portion.

Here, in the concealed slide fastener, thickness of the synthetic-resin-made film body is required to be set thick to some extent to harden the element mounting portion and the like. However, if the thickness of the film body to be fixed to the element mounting portion is set to be excessively thick, piercing of a sewing needle to the element mounting portion and the film body becomes difficult when the fastener element is sewn to the element mounting portion. Accordingly, there has been a problem that sewing of the fastener element cannot be smoothly performed.

Further, in the concealed slide fastener, irregularity and burr are to be generated at a top face or a back face of the film body when a sewing needle pierces the synthetic-resin-made film body. When irregularity and burr occur at the film body as described above, there has been a problem that appearance quality of the concealed slide fastener is lowered owing to occurrence of positional shifting of the fastener element and exposure of the irregularity and burr, for example.

To specifically address the above issues, the invention provides a fastener stringer for a concealed slide fastener which is capable of having superior concealing characteristics enabling to stably conceal a fastener element even if lateral tension force is applied to right and left fastener tapes in a state that the fastener elements are coupled without worsening hand feeling and lowering appearance quality of the fastener tapes, and further, capable of smoothly performing sewing of the fastener element when the fastener element is sewn to the element mounting portion.

Means for Solving the Problems

To achieve the above object, as a basic structure, a fastener stringer for a concealed slide fastener according to the invention includes a right-and-left pair of woven fastener tapes which respectively include a tape body portion, a tape bend portion bent into a U-shape as extending from one side edge of the tape body portion in the tape width direction, and an element mounting portion to which the fastener element is sewn as further extending from the tape bend portion; and a continuously-shaped fastener element which is sewn to the right and left fastener tape with a sewing thread. Here, the fastener stringer is characterized mainly in that the fastener tapes respectively include a hollow weave portion formed by continuous hollow weaving as accommodating a film body; the hollow weave portion includes a needle thread piercing area where a needle thread of the sewing thread at the tape bend portion side pierces; and the film body accommodated in the hollow weave portion is sewn together with the fastener element with the needle thread in a state that one side edge of the film body is located to the tape bend portion side from the needle thread.

In the fastener stringer for a concealed slide fastener according to the invention, it is preferable that the hollow weave portion is formed up to the vicinity of a position where the tape bend portions of the right-and-left pair of fastener tapes are closely contacted.

Further, it is preferable that the entire element mounting portion is formed by the hollow weaving.

In the fastener stringer for a concealed slide fastener of the invention, it is preferable that warp yarns are disposed to a tape side edge side of the element mounting portion from the other end edge of the film body as being aligned in the tape top-back direction.

In this case, it is particularly preferable that the warp yarns of the hollow weaving disposed at a tape outer face side and a tape inner face side of the film body have 1/3 and 3/1 structures and the warp yarns for positioning have a 2/2 structure.

Further, in the fastener stringer of the invention, it is preferable that at least two of the film bodies are accommodated in the hollow weaving as being overlaid.

In this case, it is particularly preferable that the film body has thickness between 0.05 mm and 0.30 mm inclusive.

Further, in the fastener stringer of the invention, it is preferable that the film body is made of at least one kind of materials being selected from groups of polyester resin, polypropylene resin, nylon resin and polycarbonate resin. In particular, it is more preferable that the film body is made of polyester resin.

Further, it is preferable that the film body has a winding shape in a wavelike fashion along the tape longitudinal direction.

Further, it is preferable that warp yarns and weft yarns forming the fastener tape adopt threads between 167 dtex and 330 dtex inclusive and 4.5 dtex/f and 10.0 dtex/f inclusive.

Furthermore, in the fastener stringer of the invention, it is preferable that the fastener element is sewn to the fastener tape in double-chain stitching with the sewing thread and the needle thread of the sewing thread adopts a thread between 840 dtex and 990 dtex inclusive and a looper thread adopts a thread between 234 dtex and 705 dtex inclusive.

Effects of the Invention

In the fastener stringer for a concealed slide fastener according to the invention, the fastener tape includes the tape body portion, the tape bend portion which is bent into a U-shape, and the element mounting portion to which the fastener element is sewn. Further, the fastener tape includes the hollow weave portion formed by continuous hollow weaving as accommodating the film body, and then, the hollow weave portion includes the needle thread piercing area where the needle thread of the sewing thread located at the tape bend portion side pierces. Furthermore, the film body accommodated in the hollow weave portion is sewn with the needle thread of the sewing thread in a state that one side edge of the film body is located to the tape bend portion side from the needle thread.

According to the fastener stringer of the invention having the above structure, since the film body is accommodated in the hollow weave portion formed by hollow weaving, stiffness of the hollow weave portion can be easily improved without impairing appearance of the fastener stringer.

In addition, since the film body is sewn with the needle thread of the sewing thread in a state that one side edge of the film body is located to the tape bend portion side from the needle thread, the film body is to be accommodated at least at the end edge portion of the tape bend portion at the element mounting portion side in an immobile state. Accordingly, stiffness of the end edge portion can be reliably improved.

With the above, a closely-contacted state between the tape bend portions of the right and left fastener tapes can be stably maintained when the right and left fastener elements are in a coupled state. At that time, even if lateral tension force to laterally open the fastener tapes is applied, the right and left tape bend portions can be more unlikely to be moved in a mutually separating direction. Accordingly, concealing characteristics of the concealed slide fastener can be improved by preventing clearance-forming between the right and left fastener tapes or by lessening clearance to be formed between the right and left fastener tapes.

In particular, in the fastener stringer of the invention, since the fastener element is sewn with the sewing thread to the element mounting portion which accommodates the film body, it is possible to have further effects of obtaining superior hand feeling at the fastener tape and superior flexibility of the fastener tape, for example, compared to a case that a fastener tape is impregnated with synthetic resin as disclosed in Patent Document 1, a case that a film body is fixed to one face of a fastener tape as an modified example of Patent Document 1, or a case that a fastener element is fixed to an element mounting portion by welding and the like.

In the above fastener stringer of the invention, it is possible that the hollow weave portion accommodating the film body is formed up to the vicinity of a position where the tape bend portions of the right and left fastener tapes are closely contacted. Accordingly, it is possible to improve stiffness of the hollow weave portion in the tape width direction from the element mounting portion to the vicinity of the position where the tape bend portions are closely contacted. With the above structure, it is possible to prevent the right and left tape bend portions more effectively from being moved in a separating direction even if lateral tension force is applied to the fastener tapes when the right and left fastener elements are in a coupled state.

Further, in the fastener stringer of the invention, it is possible that the entire element mounting portion is formed by the hollow weaving. With the above, the film body accommodated in the hollow weaving can be stably sewn with the sewing thread to the element mounting portion together with the fastener element.

In the fastener stringer of the invention, it is possible that warp yarns are disposed to the tape side edge side of the element mounting portion from the other edge of the film body as being aligned in the tape top-back direction. According to such warp yarn arrangement, the film body accommodated in the hollow weaving can be sewn to a predetermined position more reliably. In addition, it is possible to prevent occurrence of thread breakage of the warp yarns by suppressing direct contact of the warp yarns with an end part of the film body.

In this case, it is possible that the hollow weaving is formed such that the warp yarns disposed at the tape outer face side and the tape inner face side of the film body have 1/3 and 3/1 structures and the warp yarns for positioning have a 2/2 structure. With the above, the hollow weaving capable of stably holding the film body at the inside thereof can be reliably formed.

Further, in the fastener stringer of the invention, it is possible that at least two of the film bodies are accommodated in the hollow weaving as being overlaid. Various prototypes prepared by the inventors revealed that a needle can easily pierce a film body when sewing the film body to an element mounting portion of a fastener tape in a case that two film bodies having half thickness of a single film body are accommodated in the hollow weaving compared to a case that the single film body having large thickness is accommodated in the hollow weaving, for example.

In a case that the two film bodies are accommodated in the hollow weaving, the needle passes through one film body, and then, passes through the other film body after the needle top exits from the one film body. In contrast, in a case that the needle pierces one film body having thickness of the two overlaid film bodies, the needle top cannot exit from the film body until the needle completes to pierce the single film body. Thus, it is considered that needle piercing is superior with two film bodies even if the thickness is the same.

Accordingly, by accommodating at least two film bodies in the hollow weaving as being overlaid as described above, it becomes easy for a needle to pierce the film bodies and sewing of a fastener element can be smoothly performed when the film bodies are sewn to the element mounting portion together with the fastener element even if total thickness of the overlaid film bodies becomes large.

In this case, it is possible that the film body has thickness between 0.05 mm and 0.30 mm inclusive. Stiffness of the hollow weave portion of the fastener tape accommodating the film bodies can be reliably improved by setting each thickness of the film bodies to be 0.05 mm or more.

Further, owing to that the film bodies have the thickness described above, the fastener element can be located at a deeper position from a tape exposure face of the fastener stringer. Accordingly, even in a case that small clearance appears between the tape bend portions of the right and left fastener tape, for example, it is possible to make the fastener element less viewable from the tape exposure face side.

Meanwhile, the needle can pierce the film bodies more easily when sewing the film bodies to the element mounting portion together with the fastener element by setting each thickness of the film bodies to be 0.30 mm or less.

Further, in the fastener stringer of the invention, it is possible that the film body is made of at least one kind of materials being selected from groups of polyester resin, polypropylene resin, nylon resin and polycarbonate resin. Owing to that the film body is made of the above synthetic resin, in particular, of polyester resin, stiffness of the hollow weave portion can be stably improved and sewing of the fastener element can be smoothly performed.

Further, in the fastener stringer of the invention, it is possible that the film body has a winding shape in a wavelike fashion along the tape longitudinal direction. Owing to utilizing the film body having such a shape, stiffness of the abovementioned hollow weave portion in the tape width direction can be effectively improved and flexibility of the fastener tape in the tape longitudinal direction can be easily ensured.

Further, in the fastener stringer of the invention, it is possible that warp yarns and weft yarns forming the fastener tape adopt threads between 167 dtex and 330 dtex inclusive and 4.5 dtex/f and 10.0 dtex/f inclusive. With the above, stiffness of the entire fastener tape can be improved and concealing characteristics of the fastener stringer can be further improved.

Here, in a case that the fastener tape of the fastener stringer is sewn to an automobile seat cover and the like being a product, for example, the seat cover is made of relatively thick cloth. Therefore, when the tape body portion of the fastener tape is softly formed, there is a fear that problems such as sewing shrinkage occur due to occurrence of wave-shaped shrinkage at the fastener tape caused by strong tension force of the sewing thread against the fastener tape when the fastener tape is sewn to the seat cover. On the contrary, owing to that stiffness of the entire fastener tape is improved as described above, it is possible to prevent occurrence of problems such as sewing shrinkage even when the fastener tape is sewn to a thick product.

Further, in the fastener stringer of the invention, it is possible that the fastener element is sewn to the fastener tape in double-chain stitching with the sewing thread and the needle thread of the sewing thread adopts a thread between 840 dtex and 990 dtex inclusive and a looper thread adopts a thread between 234 dtex and 705 dtex inclusive.

When fastener element is sewn to the element mounting portion of the fastener tape by utilizing the sewing thread having the needle thread and the looper thread as described above, it is possible that the fastener element is sewn to the element mounting portion as being strongly tightened with the needle thread without causing thread breakage. Further, owing to that the looper thread appearing on a lower leg portion of the fastener element is set to be thinner than the needle thread, the looper thread can be unobtrusive and appearance of the fastener stringer can be improved.

BEST MODE FOR CARRYING OUT THE INVENTION

In the following, embodiments of the invention will be described in detail with reference to the drawings.

Figure 1:
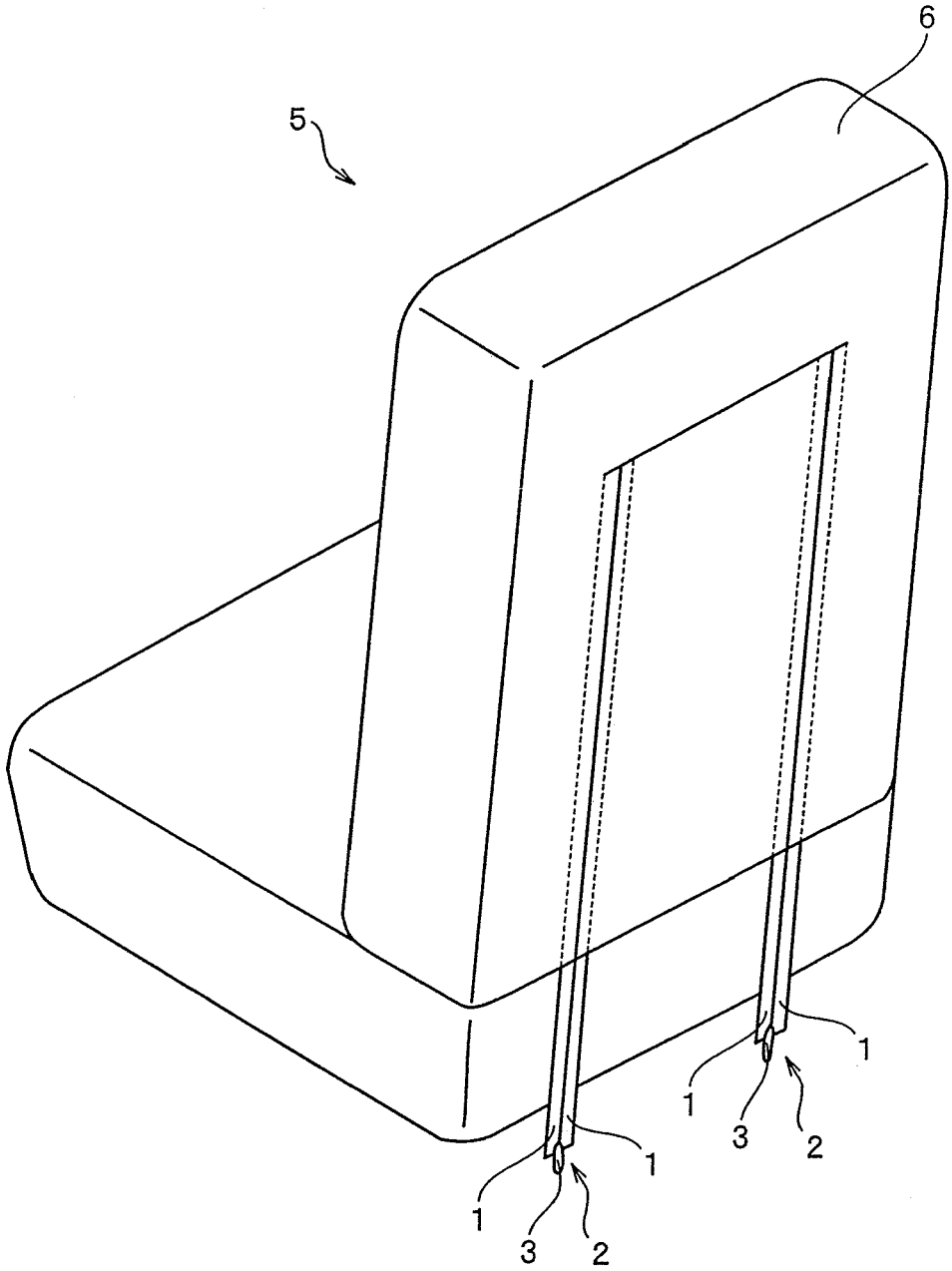
FIG. 1 is a perspective view illustrating an automobile seat for which a fastener stringer for a concealed slide fastener according to the invention is used.
Figure 2:
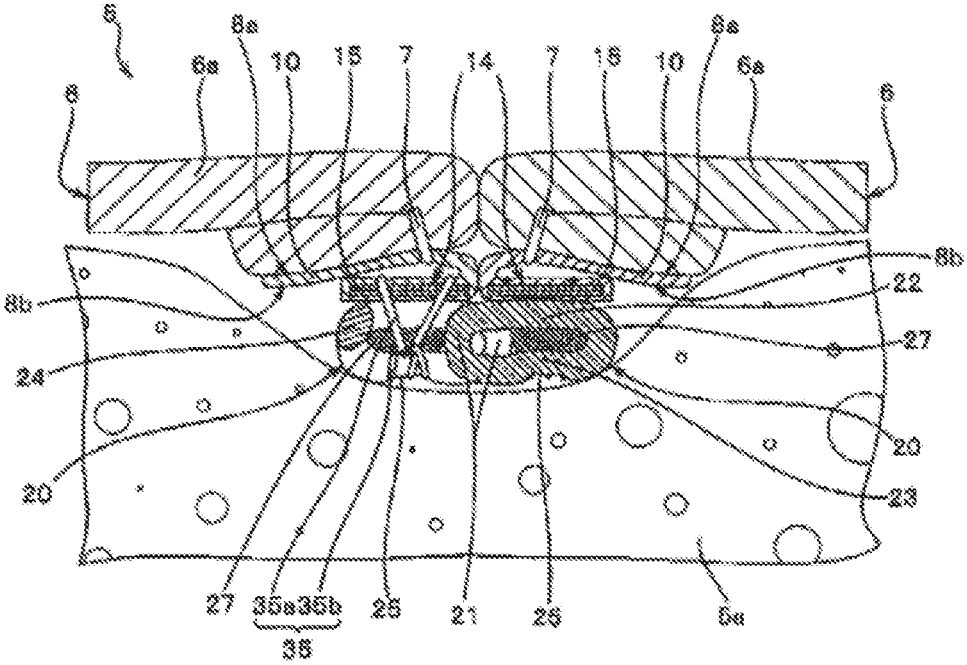
FIG. 2 is a sectional view schematically illustrating a state that the fastener stringer is sewn to a surficial member of an automobile seat.
Figure 3:
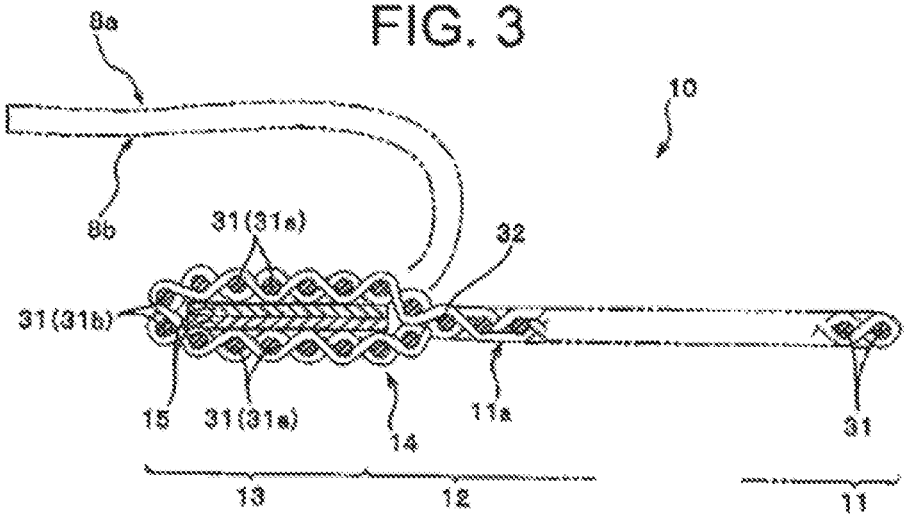
FIG. 3 is a sectional view schematically illustrating a part of a weaving structure of a fastener tape.
Figure 4:
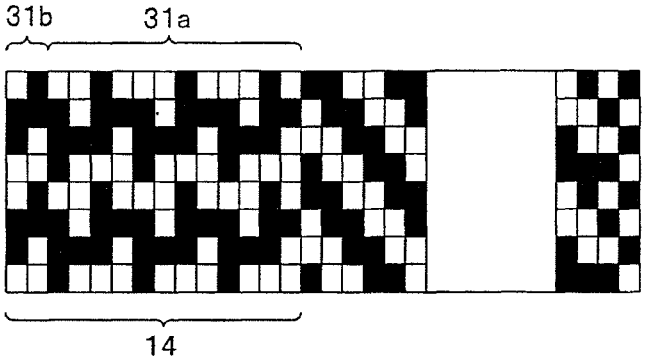
FIG. 4 is a weaving structure view illustrating a partially-omitted weaving structure of the fastener tape.
Figure 5:
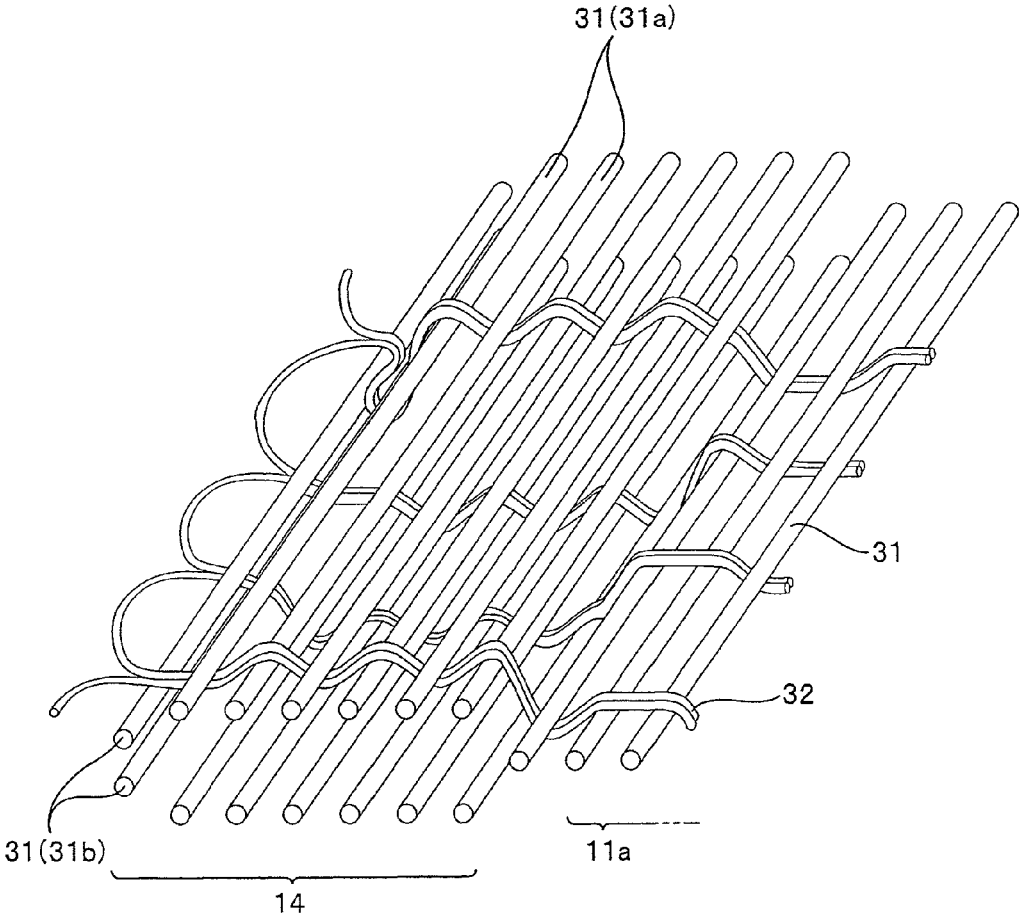
FIG. 5 is a perspective view schematically illustrating a weaving structure of the fastener tape.

Here, FIG. 1 is a perspective view illustrating an automobile seat for which a fastener stringer for a concealed slide fastener according to the present embodiment is used. FIG. 2 is a sectional view schematically illustrating a state that the fastener stringer is sewn to a surficial member of an automobile seat. Further, FIGS. 3 to 5 are views schematically illustrating a weaving structure of a fastener tape.

In the drawings referred to description of the present embodiment, diverse warp yarns and weft yarns are illustrated relatively thick and a weaving structure of a fastener tape is coarsely illustrated to facilitate understanding of features of the invention. In an actual fastener stringer, specific yarns of which thickness and the like are previously set are used for diverse warp yarns and weft yarns structuring a fastener tape. Further, a weaving structure of a fastener tape is finely formed.

A fastener stringer 1 for a concealed slide fastener according to the present embodiment can structure a concealed slide fastener 2 as having a slider 3 slidably attached along fastener elements 20. The concealed slide fastener 2 structured by utilizing the fastener stringer 1 of the present embodiment is used as being attached to a back face side of a seat cover 6 of an automobile seat 5 as illustrated in FIG. 1, for example.

In this case, as illustrated in FIG. 2, the concealed slide fastener 2 is attached to the seat cover 6 by sewing a tape body portion 11 of a fastener tape 10 of the fastener stringer 1 to a surficial member 6*a* of the seat cover 6 with a sewing thread 7. Description on the tape body portion 11 will be performed later. Further, the concealed slide fastener 2 is arranged between a cushion body 5*a* of the automobile seat 5 and the surficial member 6*a* of the seat cover 6.

As illustrated in FIG. 3, the fastener stringer 1 of the present embodiment to be adopted to the seat cover 6 for automobiles and the like includes a right-and-left pair of woven fastener tapes 10, and coil-shaped fastener elements 20 sewn respectively to the right and left fastener tapes 10.

The right and left fastener tapes 10 respectively include the tape body portion 11 to be sewn to the surficial member 6*a* of the seat cover 6, a tape bend portion 12 which is bent into a U-shape as extending from one side edge of the tape body portion 11 in the tape width direction, and a flat-shaped element mounting portion 13 further extending from the tape bend portion 12. The tape body portion 11 has a front surface 8*a* and a back surface 8*b*. The tape bend portion 12 is bent towards the back surface 8*b* of the tape body portion.

Further, the fastener tape 10 is woven to have a weaving structure as illustrated in FIGS. 3 to 5. Here, the weaving structure of the fastener tape 10 will be specifically described. In FIG. 4, black sections denote warp yarns routed above a weft yarn.

The tape body portion 11 of the fastener tape 10 is woven to single weave with a plurality of warp yarns 31 and weft yarns 32 in which two single yarns are coupled as being paralleled. Then, the weaving structure of the tape body portion 11 is a 2/2 structure in which each warp yarn 31 is routed alternately to the upper side (i.e., the tape inner face side) of two sets of weft yarns 32 and to the lower side (i.e., the tape outer face side) of two sets of weft yarns 32.

In this case, polyester fibers between 167 dtex and 330 dtex inclusive and 4.5 dtex/f and 10.0 dtex/f inclusive, and preferably between 200 dtex and 300 dtex inclusive and 6.0 dtex/f and 8.0 dtex/f inclusive, are utilized for each single yarn arranged as the warp yarns 31 and the weft yarns 32. Generally, yarns having such thickness are called low-count yarns.

Stiffness of the tape body portion 11 can be improved by structuring the warp yarns 31 and the weft yarns 32 with the abovementioned low-count yarns. For example, in a case that the surficial member 6*a* of the automobile seat cover 6 is formed thick (see FIG. 2), it is possible to prevent occurrence of wave-shaped shrinkage at the fastener tape 10 caused by tension force of the sewing thread 7 against the fastener tape 10 even when the tape body portion 11 of the fastener tape 10 is sewn to the surficial member 6*a* with the sewing thread 7 by improving the stiffness of the tape body portion 11 as described above. Accordingly, it is possible to prevent occurrence of problems such as sewing shrinkage. Here, in the invention, material of the warp yarns 31 and the weft yarns 32 is not specifically limited. It is possible to arbitrarily select and utilize synthetic fibers, natural fibers and the like other than polyester fibers for the warp yarns 31 and the weft yarns 32.

The tape bend portion 12 of the fastener tape 10 is woven with a plurality of the warp yarns 31 and the weft yarns 32. The tape bend portion 12 includes a single weave portion 11*a* formed of the same weaving structure as the tape body portion 11 and a hollow weave portion 14 formed by hollow weaving. In this case, the single weave portion 11*a* of the tape bend portion 12 having the same weaving structure as the tape body portion 11 is formed continuously from the tape body portion 11.

Further, the hollow weave portion 14 of the tape bend portion 12 is arranged at the element mounting portion 13 side from the vicinity of a contacting section where the right and left tape bend portions 12 are closely contacted when the right end left fastener elements 20 are coupled as described later.

The element mounting portion 13 of the fastener tape 10 includes the hollow weave portion 14 which is formed continuously from the tape bend portion 12. In the present embodiment, the hollow weave portion 14 is formed throughout the element mounting portion 13.

Further, the hollow weave portion 14 which is formed continuously at the tape bend portion 12 and the element mounting portion 13 accommodates two film bodies 15 in an overlaid state. In this case, the warp yarns 31 arranged at the hollow weave portion 14 includes a plurality of warp yarns 31*a* which are disposed to the tape inner side and the tape outer side of the film bodies 15 so as to nip the film bodies 15, and two warp yarns 31*b* which are disposed to an end edge at the element mounting 13 side. Further, an end part of the hollow weave portion 14 at the tape bend portion 12 side is closed with a single weave portion 11*a* (i.e., connecting threads) formed at the tape bend portion 12.

The plurality of warp yarns 31*a* disposed at the tape inner face side and the tape outer face side of the hollow weave portion 14 are woven as 1/3 and 3/1 structures in which the warp yarn 31*a* disposed to the tape inner face side is routed to the lower side (i.e., the film bodies 15 side) of a set of the weft yarns 32 and to the upper side (i.e., the tape inner face side) of three sets of the weft yarns 32 while the warp yarn 31*a* disposed to the tape outer face side is routed to the lower side (i.e., the tape outer face side) of three sets of weft yarns 32 and to the upper side (i.e., the film bodies 15 side) of a set of the weft yarns 32.

Meanwhile, the two warp yarns 31*b* disposed to the end edge of the hollow weave portion 14 at the element mounting portion 13 side are arranged in parallel to the tape longitudinal direction as being aligned in the tape top-back direction as positioning warp yarns which regulate an end edge position of the film bodies 15 at the element mounting portion 13 side. The weft yarns 31*b* are woven as the 2/2 structure in which each thereof is routed alternately to the upper side (i.e., the tape inner side) of two sets of the weft yarns 32 and to the lower side (i.e., the tape outer side) of two sets of weft yarns 32.

Here, yarns similar to the warp yarns 31 disposed to the tape body portion 11 are utilized for the warp yarns 31 disposed to the single weave portion 11*a* of the tape bend portion 12 and the warp yarns 31 disposed to hollow weave portion 14 of the tape bend portion 12 and the element mounting portion 13. However, in the invention, material of the warp yarns 31 disposed to the tape bend portion 12 and the element mounting portion 13 is not specifically limited.

In the present embodiment, the hollow weave portion 14 formed at the tape bend portion 12 and the element mounting portion 13 accommodates the two film bodies 15 as being overlaid. The film bodies 15 are formed of polyester resin which is capable of being plastically deformed at normal temperature. Thickness of the respective film bodies 15 is set between 0.05 mm and 0.30 mm inclusive, and preferably between 0.15 mm and 0.20 mm inclusive.

Stiffness of the hollow weave portion 14 accommodating the film bodies 15 can be reliably improved by setting each thickness of the film bodies 15 to be 0.05 mm or more, in particular, to be 0.15 mm or more.

Further, as described in detail in the following, when the fastener element 20 is sewn to the element mounting portion 13 with the sewing thread 35, sewing of the fastener element 20 is performed while a sewing needle 36 pierces the fastener tape 10 and the film bodies 15. In this case, the sewing needle 36 can easily pierce the film bodies 15 by setting each thickness of the film bodies 15 to be 0.30 mm or less, in particular, to be 0.20 mm or less. Accordingly, sewing of the fastener element 20 can be smoothly performed. Actually, in the present embodiment, the hollow weave portion 14 accommodates the two film bodies 15 made of polyester resin having thickness of 0.19 mM.

Figure 6:
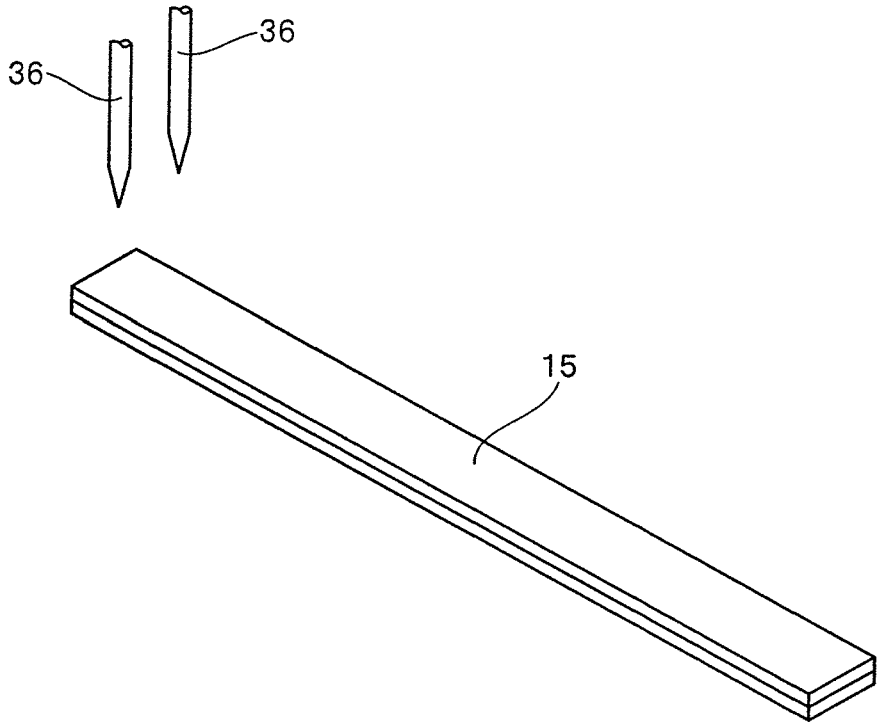
FIG. 6 is a perspective view illustrating a state of a film body accommodated in hollow weaving of the fastener tape before being sewn.
Figure 7:
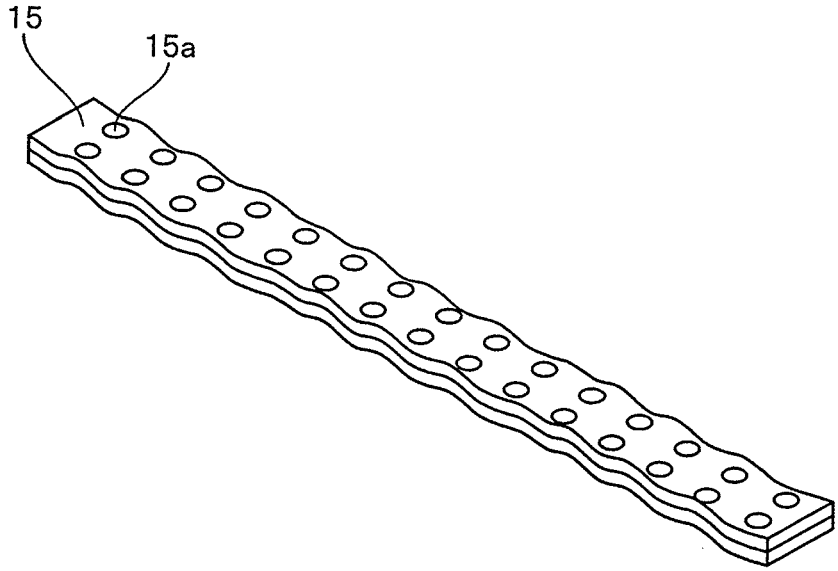
FIG. 7 is a perspective view illustrating a state of the film body accommodated in the hollow weaving of the fastener tape after being sewn.

In this case, at the time right after weaving of the fastener tape 10, the two film bodies 15 are accommodated in the hollow weave portion 14 of the fastener tape 10 in a straight state, as illustrated in FIG. 6. Subsequently, when the fastener element 20 is sewn to the element mounting portion 13 of the fastener tape 10 with up and down movement of the sewing needle 36, a plurality of piercing holes 15*a* through which the sewing thread 35 (i.e., a needle thread 35*a*) passes are formed at the film bodies 15 as illustrated in FIG. 7 owing to piercing of the sewing needle 36 to the film bodies 15. At that time, the film bodies 15 are deformed into a winding shape (i.e., a meander shape) in a wavelike fashion in the tape longitudinal direction as receiving stress, friction force and the like from the sewing needle 36 when the sewing needle 36 pierces the film bodies 15 from a top face side to a back face side.

The wavelike shape of the film bodies 15 in the tape longitudinal direction can effectively improve stiffness of the hollow weave portion 14 of the fastener tape 10 in the tape width direction. Meanwhile, it is possible to suppress decrease in flexibility in the tape longitudinal direction due to accommodating of the film bodies 15 in the hollow weave portion 14.

Here, when the sewing needle 36 pierces the film bodies 15 as described above, there may be a case that irregularity, burr and the like occur at a top face or a back face of the film bodies 15. However, in the fastener stringer 1 of the present embodiment, since the film bodies 15 are arranged in the hollow weave portion 14, winding, irregularity, burr and the like occurring at the film bodies 15 are not exposed to the outside. Accordingly, appearance quality of the fastener stringer 1 is not lowered.

Further, in the invention, it is also possible to form wave like winding at the film bodies 15 by increasing tension force of the weft yarns 32 which structure the fastener tape 10, for example. Owing to forming of wavelike winding at the film bodies 15 as describe above, it is also possible to effectively improve stiffness of the hollow weave portion 14 in the tape width direction and to suppress decrease in flexibility in the tape longitudinal direction. Here, not only by piercing of the sewing needle 36, the winding of the film bodies 15 may be formed by previously deforming the film bodies 15 into a meander shape in the longitudinal direction.

Further, in the invention, not being specifically limited, the film bodies 15 accommodated in the hollow weave portion 14 may appropriately utilize material of synthetic resin such as polypropylene resin, nylon resin and polycarbonate resin, for example other than polyester resin. Further, in the present embodiment, the two film bodies 15 accommodated in the hollow weave portion 14 are made of the same material. However, in the invention, it is also possible that the two film bodies 15 made of mutually different material are accommodated in the hollow weave portion 14.

Figure 9:
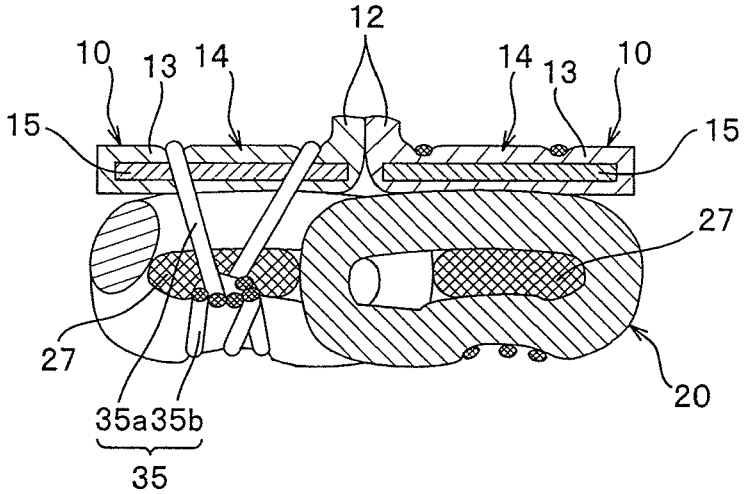
FIG. 9 is a main part sectional view illustrating a main part of a fastener stringer having a single film body accommodated in hollow weaving of a fastener tape.

Furthermore, the present embodiment exemplifies a structural example that the two film bodies 15 are accommodated in the hollow weave portion 14. However, depending on thickness of the film body 15, it is also possible that a single film body 15 is accommodated in the hollow weave portion 14 as illustrated in FIG. 9 or that three or more film bodies 15 are accommodated in the hollow weave portion 14, for example.

In the following, description will be performed on studies of the inventors on relation between thickness of the film body 15 accommodated in the hollow weave portion 14 and easiness of sewing the fastener element 20. The studies of the inventors revealed that excessive thickness per sheet of the film body 15 accommodated in the hollow weave portion 14 of the fastener tape 10 caused difficulty for the sewing needle 36 to pierce the film bodies 15 when sewing the fastener element 20 to the element mounting portion 13 of the fastener tape 10 and caused a fear of negative influence to sewing the fastener element 20.

For example, when the polyester-resin-made film body 15 of which thickness is larger than 0.30 mm is accommodated in the hollow weave portion 14 of the fastener tape 10, there has been a case of occurring a problem of inferior sewing of the fastener element 20 owing to difficulty for the sewing needle 36 to pierce the film body 15 at the time of sewing the fastener element 20.

In contrast, when at least two of the film bodies 15 of which thickness is 0.30 mm or less are accommodated in the hollow weaving, it was revealed that the sewing needle 36 can easily pierce the film bodies 15 and sewing the fastener element 20 can be smoothly performed at the time of sewing the fastener element 20 to the element mounting portion 13 even if the total thickness of the two film bodies 15 is larger than 0.3 mm.

The following is a possible reason of the above. That is, in a case that two film bodies are accommodated in hollow weaving, a needle passes through one film body, and then, passes through the other film body after the needle top exits from the one film body. Accordingly, regarding needle piercing, it is simply required to pass through one film body at first, and then, to pass through the next film body after the needle top exits. Thus, some clearance can be formed between the two overlaid film bodies. Since the needle passes through the film bodies approximately one by one, it is considered that the needle piercing is improved as a whole.

In contrast, in a case that a needle pierces a single film body having the same thickness as that of two overlaid film bodies, the needle top cannot exit from the film body until the needle completes to pierce the single thickened film body. Accordingly, even with a proceeding amount as that of a case that the needle top exits from one film body out of two film bodies, the needle top proceeds only to an intermediate position of the single film body of which thickness is equal to that of the two overlaid film bodies. Thus, it is considered that needle piercing is superior with two film bodies even if the thickness is the same.

Accordingly, when two of the polyester-resin-made film bodies 15 having thickness of 0.19 mm are accommodated in the hollow weave portion 14 as in the present embodiment, the sewing needle 36 can easily pierce the element mounting portion 13 of the woven fastener tape 10 and sewing fastener element 20 can be stably performed even though the total thickness of the two film bodies 15 is larger than 0.3 mm.

Here, in a case that a plurality of film bodies 15 having thickness of 0.30 mm or less each are accommodated in the hollow weave portion 14, it is preferable that the total thickness of the plurality of film bodies 15 is 0.60 mm or less.

The right and left fastener elements 20 of the present embodiment are formed respectively into a continuous coil-like shape. Further, each fastener element 20 includes a coupling head 21, upper and lower leg portions 22, 23 extending from the coupling head 21, and a connecting portion 24 which connects the mutually adjacent fastener elements 20. The core thread 27 passes between the upper and lower leg portions 22, 23. Further, a recess 25 capable of accommodating the sewing thread 35 with which the fastener element 20 is sewn to the fastener tape 10 is formed at a lower face of the lower leg portion 23 of the fastener element 20.

The fastener element 20 as described above is sewn to the element mounting portion 13 of the fastener tape 10 in double-chain stitching with the sewing thread 35 together with the two film bodies 15. In this case, the sewing thread 35 includes the needle thread 35*a* passing through the element mounting portion 13 of the fastener tape 10 and the film bodies 15, and a looper thread 35*b* routed at the lower leg portion 23 side of the fastener element 20 as being interlaced with the needle thread 35*a* between the fastener elements 20.

Here, as an area of the fastener tape 10 where the needle thread 35*a* of the sewing thread 35 piercing at the tape bend portion 12 side being denoted by a needle thread piercing area, the hollow weave portion 14 of the fastener tape 10 is formed to include at least the needle thread piercing area. With the above, it is possible to fix the location of the film bodies 15 by reliably sewing the film bodies 15 accommodated in the hollow weave portion 14 with the needle thread 35*a* routed at the tape bend portion 12 side. In this case, the film bodies 15 are fixed in a state that one side edge of the film bodies 15 are located further to the tape bend portion 12 side from the needle thread 35*a* at the tape bend portion 12 side.

In the present embodiment, the needle tread 35*a* of the sewing thread 35 adopts a thread between 840 dtex and 990 dtex inclusive. Meanwhile, the looper thread 35*b* adopts a thread between 234 dtex and 705 dtex inclusive. According to utilization of a thicker thread for the needle thread 35*a* of the sewing thread 35 than the looper thread 35*b*, the fastener element 20 can be strongly tightened and sewn to the element mounting portion 13 with the needle thread 35*a* without causing thread breakage.

Further, according to utilization of a thinner thread for the looper thread 35*b* of the sewing thread 35 than the needle thread 35*a*, the looper thread 35*b* exposed to the lower leg portion 23 side of the fastener element 20 can be unobtrusive to the extent possible. Accordingly, appearance of the fastener stringer 1 can be improved.

Furthermore, in the fastener stringer 1 of the present embodiment, the looper thread 35*b* of the sewing thread 35 is accommodated in the recess 25 of the fastener element 20 when the fastener element 20 is sewn. Accordingly, even if the slider 3 is slid along an element row of the fastener elements 20 with the structure of the concealed slide fastener 2, the looper thread 35*b* can be prevented from being interfered with the slider 3. Therefore, it is possible to prevent occurrence of thread breakage at the looper thread 35*b* due to friction between the looper thread 35*b* and the slider 3.

Next, a method of manufacturing the fastener stringer 1 according to the present embodiment will be described.

First, the fastener tape 10 having the weaving structure illustrated in FIGS. 3 to 5 is woven with weft-routing of the weft yarns 32 as reciprocating a carrier bar in an opening of the warp yarns 31 by utilizing a double-warp loom. At the same time of weaving the fastener tape 10, the film bodies 15 are woven in the hollow weave portion 14 of the fastener tape 10 by supplying the overlaid film bodies 15 as one of the warp yarns. In this manner, it is possible to obtain the stripe-shaped fastener tape 10 accommodating the two film bodies 15 in the hollow weave portion 14 in a straight state as illustrated in FIG. 6.

Subsequently, the coil-shaped fastener element 20 is sewn to the element mounting portion 13 of the fastener tape 10 which is woven as described above. At that time, the fastener element 20 is sewn to the stripe-shaped fastener tape 10 which is not bent into a U-shape yet by utilizing the sewing thread 35 in a state that the core thread 27 is routed between the upper and lower leg portions 22, 23 of the fastener element 20.

Further, the fastener element 20 is sewn in double-chain stitching with the sewing thread 35 which includes the needle thread 35*a* and the looper thread 35*b* in a state that the coupling head 21 is oriented to the tape bend portion 12 side of the fastener tape 10 and the upper leg portion 22 is contacted to the fastener tape 10.

Here, when sewing of the fastener element 20 is performed with the sewing thread 35 as described above, the film bodies 15 accommodated in the hollow weave portion 14 of the fastener tape 10 are also sewn with the sewing thread 35 to the fastener tape 10 together with the fastener element 20. In the present embodiment, since the film bodies 15 are accommodated throughout the element mounting portion 13, the fastener element 20 can be firmly sewn to a predetermined position Further, in this case, since the sewing needle 36 for performing sewing sews the fastener element 20 while piercing the fastener tape 10 and the two film bodies 15, the plurality of piercing holes 15*a* through which the needle thread 35*a* of the sewing thread 35 passes are formed as being aligned in two lines and the film bodies 15 are deformed into a winding form in a wavelike fashion along the tape longitudinal direction, as illustrated in FIG. 7.

Subsequently, the coupling head 21 of the fastener element 20 is protruded outward from the tape bend portion 12 by bending the fastener tape 10 to which the fastener element 20 is sewn into a U-shape at the tape bend portion 12.

At that time, the location of the film bodies 15 in the hollow weave portion 14 is restricted by the two warp yarns 31*b* disposed at the end part of the hollow weave portion 14 at the tape bend portion 12 side. Further, the location of the film bodies 15 is fixed by the sewing thread 35. Accordingly, the film bodies 15 accommodated in the hollow weave portion 14 is not moved even when the fastener tape 10 is bent into a U-shape as described above. Thus, the location thereof can be stably maintained.

After the fastener tape 10 is bent as described above, the right and left fastener elements 20 are coupled. Further, thermal setting and the like are performed on the fastener stringer 1 in a state that the right and left fastener elements 20 are coupled. In this manner, the abovementioned fastener stringer 1 according to the present embodiment is manufactured.

In the fastener stringer 1 obtained as described above, the two film bodies 15 are fixed with the sewing thread 35 in a state of being accommodated in the hollow weave portion 14. According to the above structure, the fastener stringer 1 is configured to have the area of the fastener tape 10 having increased stiffness where the hollow weave portion 14 is formed without lowering appearance quality.

In particular, since the hollow weave portion 14 is formed at the tape bend portion 12 side from the needle thread 35*a* of the sewing thread 35 in the fastener stringer 1, stiffness of the tape section up to the vicinity of a position where the tape bend portions 12 are closely contacted is reliably improved when the right and left fastener elements 20 are in a coupled state. Further, in this case, since the fastener element 20 and the film bodies 15 are connected with the sewing thread 35 and relative positional deviation is prevented between the fastener element 20 and the film bodies 15, the closely-contacted state between the right and left tape bend portions 12 can be stably maintained.

Figure 8:
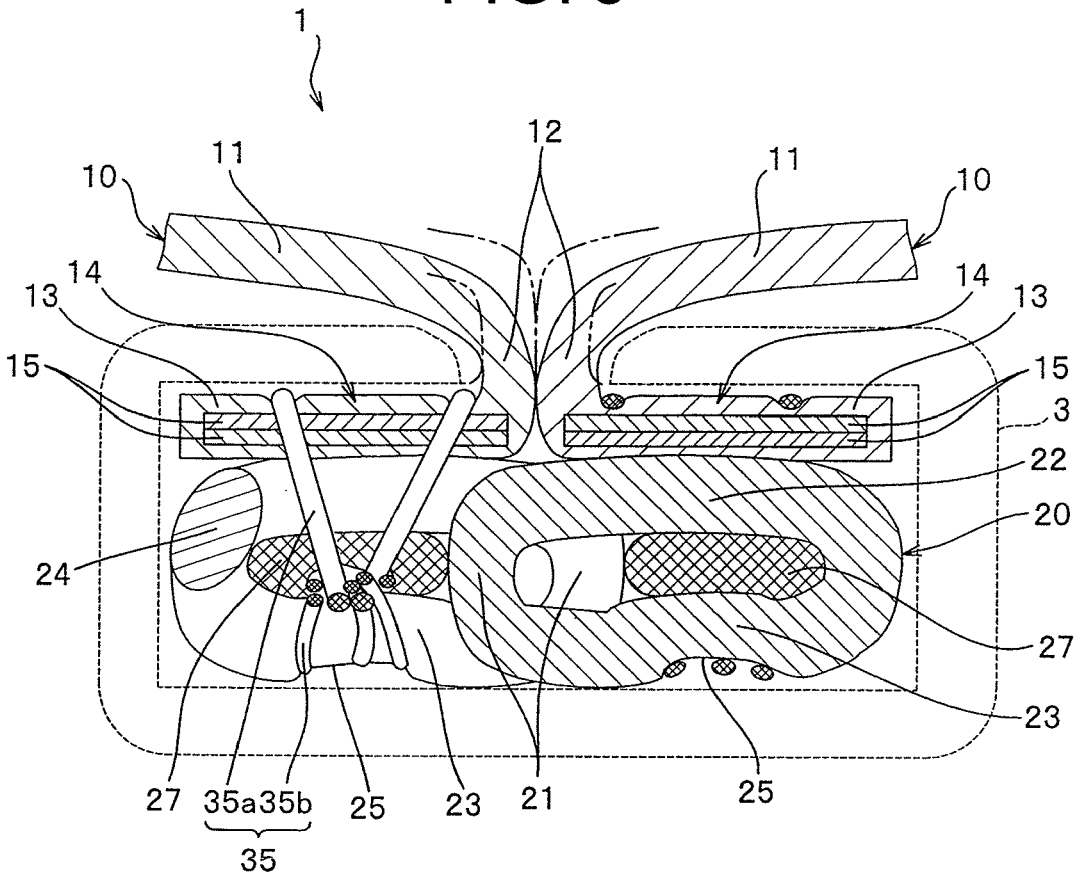
FIG. 8 is a sectional view illustrating a state that the fastener stringer receives lateral tension force.

Accordingly, the fastener stringer 1 of the present embodiment remarkably improves concealing characteristics to conceal the fastener elements 20. For example as illustrated in FIG. 8, even when lateral tension force to open the fastener tapes 10 in the lateral direction is applied in a state that the right and left fastener elements 20 are coupled, clearance-forming is suppressed between the right and left fastener tapes 10. Accordingly, compared to a general concealed slide fastener in the related art, the fastener elements 20 can be further prevented from being viewed through the clearance from an exposure face side of the fastener stringer 1.

Further, in the fastener stringer 1 of the present embodiment, since the film bodies 15 are accommodated in the hollow weave portion 14 of the fastener tape 10, the distance from the exposure face of the fastener stringer 1 to the fastener element 20 is maintained longer than that of the conventional fastener stringer 1. According to the above lengthened distance from the exposure face of the fastener stringer 1 to the fastener element 20, visibility of the fastener element 20 from the exposure face side of the fastener stringer 1 can be reduced even if small clearance is formed between the right and left fastener tapes 10 when strong lateral tension force is applied to the fastener stringer 1, for example.

Accordingly, in a case that the concealed slide fastener 2 using the fastener stringer 1 of the present embodiment is used for the seat cover 6 for automobiles as illustrated in FIG. 1, the right and left fastener elements 20 in a coupled state can be effectively prevented from being viewed from the cover outside.

In this manner, it is possible to solve problems in the related art such that appearance and design of the automobile seat 5 are worsened owing to visibility of the fastener elements 20.

The above embodiment describes a preferable example of the fastener stringer 1 within the scope of the invention. Here, not limited to the above structure, the invention can be variously modified under conditions of having substantially the same structure and similar operational effects.

For example, in the above embodiment, description is performed on a case that the continuous fastener element 20 formed into a coil shape is sewn to the element mounting portion 13 of the fastener tape 10. However, instead of the coil shape, for example, it is also possible to sew a zigzag-shaped continuous fastener element to the element mounting portion 13.

Further, in the invention, length of the hollow weave portion 14 and the film body 15 of the fastener tape 10 can be arbitrarily modified as long as one side edge of the hollow weave portion 14 accommodating the film body 15 (in other words, one side edge of the film body 15) is arranged at the tape bend portion 12 side from the needle thread 35*a* of the sewing thread 35.

Figure 10:
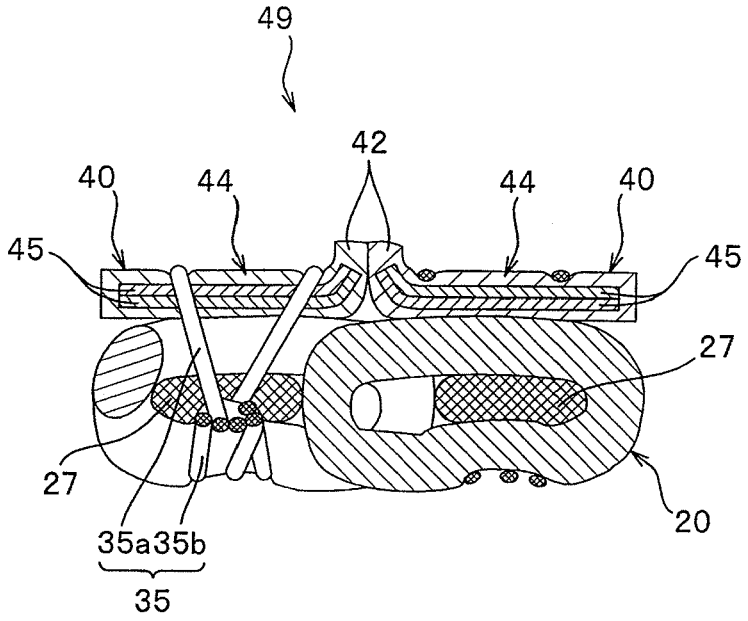
FIG. 10 is a sectional view illustrating a modified example of a fastener stringer for a concealed slide fastener according to the invention.

As illustrated in FIG. 10 for example, it is also possible to structure a fastener stringer 49 in which a hollow weave portion 44 accommodating a film body 45 of a fastener tape 40 is formed longer to a tape bend portion 42 side than that in the fastener stringer 1 (see FIG. 2) of the above embodiment.

In this case, thermal setting is performed on the fastener stringer 49 in a state that the side edge section of the film body 45 at the tape bend portion 42 side is bent together with a fastener tape 40. Since the hollow weave portion 44 accommodating the film body 45 can be formed longer to the tape bend portion 42 side as described above, clearance occurrence can be further prevented between tape bend portions 42 of the right and left fastener tapes 40 when the right and left fastener elements 20 are coupled. Accordingly, concealing characteristics of the fastener stringer 49 can be further improved.

Figure 11:
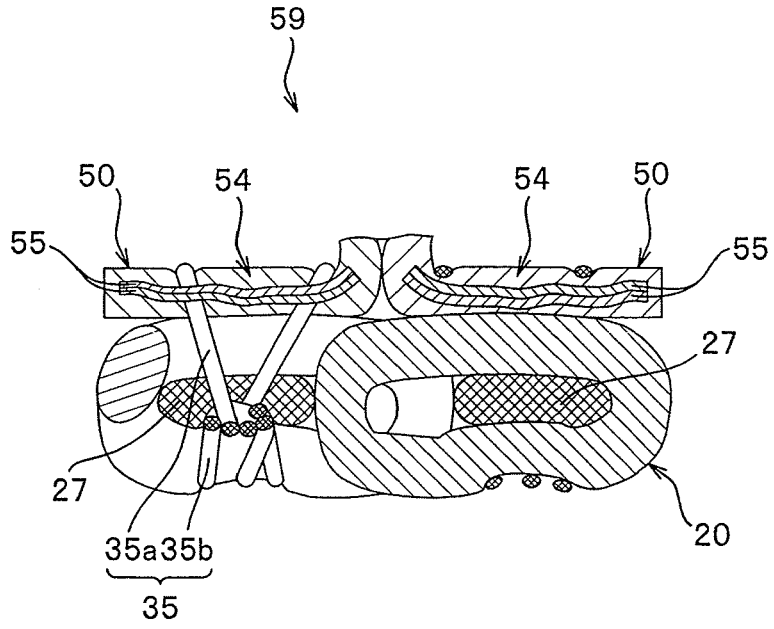
FIG. 11 is a sectional view illustrating another modified example of a fastener stringer for a concealed slide fastener according to the invention.

For example, in a case that dyeing processing is performed as a later process on the fastener stringer 49 illustrated in FIG. 10, shrinkage occurs at the fastener tape 40 and the film body 45. Accordingly, as illustrated in FIG. 11, in a fastener stringer 59 to which dyeing is performed, a film body 55 is accommodate in a hollow weave portion 54 of a fastener tape 50 as being deformed into a winding shape in the top-back direction in a wavelike manner along the tape width direction owing to the shrinkage. Even in the fastener stringer 59 to which dyeing is performed, stiffness of the hollow weave portion 54 of the fastener tape 50 is increased by the film body 55 to provide superior concealing characteristics.

Figure 12:
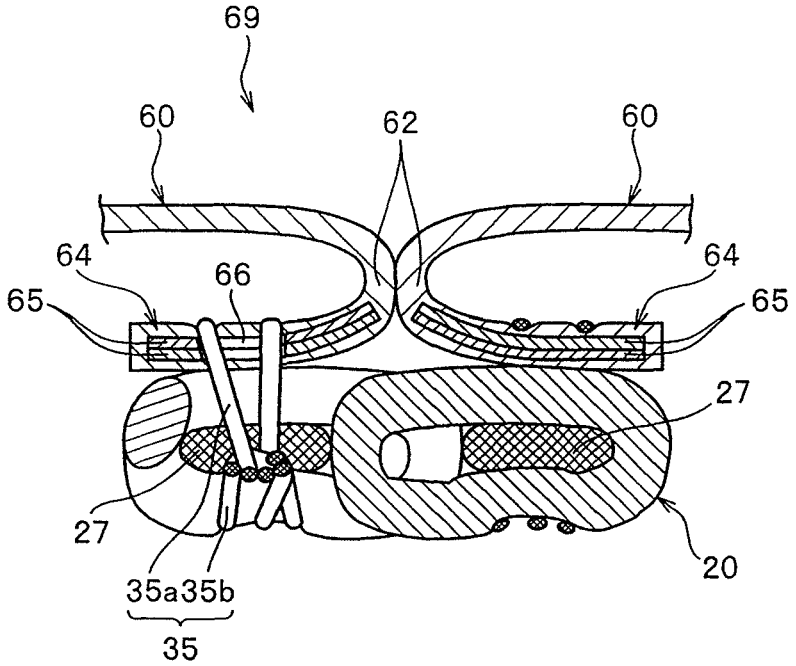
FIG. 12 is a sectional view illustrating another modified example of a fastener stringer for a concealed slide fastener according to the invention.
Figure 13:
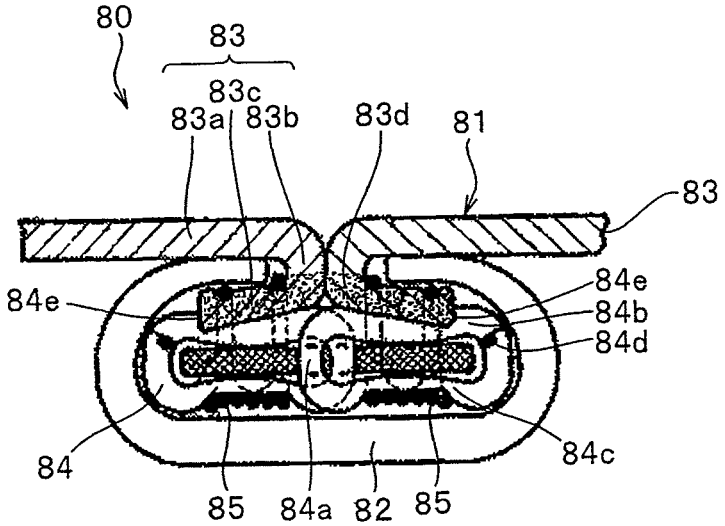
FIG. 13 is a sectional view illustrating a concealed slide fastener in the related art.

Further, in the invention, it is also possible to arbitrarily modify location of a sewing thread for sewing a fastener element against a fastener tape. As illustrated in FIG. 12 for example, a fastener stringer 69 can be structured such that the needle thread 35*a* of the sewing thread 35 routed at a tape bend portion 62 side is located as being closer to the connecting portion 24 side of the fastener element 20 compared to the fastener stinger 1 (see FIG. 2) according to the above embodiment.

In the fastener stringer 69 illustrated in FIG. 12, when two needle threads 35*a* pierce a film body 65 for sewing the fastener element 20, a single needle hole 66 is formed for the two needle threads 35*a* owing to short distance between two needles. Here, in the fastener stringer 69 as well, a hollow weave portion 64 accommodating the film body 65 is formed longer to the tape bend portion 42 side compared to the fastener stringer 1 of the above embodiment.

In the abovementioned fastener stringer 69, each film body 65 accommodated in the right and left fastener tapes 60 is bent to be apart rising from the fastener element 20 toward a close contact section of the tape bend portion 62 when the right and left fastener elements 20 are coupled. In this case, since the right and left film bodies 65 are in a mutually-pushed state, the right and left tape bend portions 42 can be closely contacted to each other more stably.

Here, considering a fastener stringer for a concealed slide fastener in the related art, sewing of a fastener element becomes easy to be performed when a needle thread of a sewing thread routed to a tape bend portion side is shifted to a connecting portion side of the fastener element. However then, since clearance is more likely to occur between the right and left tape bend portions when the right and left fastener elements are coupled, there arises a problem that concealing characteristics of the fastener stringer are drastically impaired.

In contrast, in the fastener stringer 69 illustrated in FIG. 12, since stiffness at the hollow weave portion 64 of the fastener tape 60 is increased by the film body 65, superior concealing characteristics of the fastener stringer 49 can be stably ensured even in a case that the needle thread 35*a* of the sewing thread 35 at the tape bend portion 42 side is routed to be close to the connecting portion 24 side of the fastener element 20 as described above.

DESCRIPTION OF REFERENCE NUMERALS

1 Fastener stringer
2 Concealed slide fastener
3 Slider
5 Automobile seat
5*a* Cushion body
6 Seat cover
6*a* Surficial member
7 Sewing thread
8*a* Front Surface
8*b* Back Surface
10 Fastener tape
11 Tape body portion
11*a* Single weave portion
12 Tape bend portion
13 Element mounting portion
14 Hollow weave portion
15 Film body
15*a* Piercing hole
20 Fastener element
21 Coupling head
22 Upper leg portion
23 Lower leg portion
24 Connecting portion
25 Recess
27 Core thread
31 Warp yarn
31*a*, 31*b* Warp yarn
32 Weft yarn
35 Sewing thread
35*a* Needle thread
35*b* Looper thread
36 Sewing needle
40 Fastener tape
42 Tape bend portion
44 Hollow weave portion
45 Film body
49 Fastener stringer
50 Fastener tape
54 Hollow weave portion
55 Film body
29 Fastener stringer
60 Fastener tape
62 Tape bend portion
64 Hollow weave portion
65 Film body
66 Needle hole
69 Fastener stringer

The invention claimed is:

1. A fastener stringer for a concealed slide fastener, comprising: a right woven fastener tape and a left woven fastener tape, each having a front and a back surface and each including a tape body portion, a tape bend portion extending from one side edge of the tape body portion in a tape width direction, and an element mounting portion to which a fastener element is sewn with a sewing thread that extends from a side edge of the tape bend portion opposite the tape body portion, wherein the tape bend portion is bent into a U-shape towards the back surface of the tape body portion, wherein the element mounting portion of the respective fastener tape includes a hollow weave portion that completely surrounds a film body in the tape width direction, wherein the tape body portion has a single weave weaving structure and the hollow weave portion of the element mounting portion has a hollow weave weaving structure, and wherein the fastener element is sewn together with a needle thread that pierces the hollow weave portion and the film body and one side edge of the film body is located closer to the tape bend portion than the needle thread.

2. The fastener stringer for a concealed slide fastener according to claim 1, wherein the hollow weave portion is formed up to a vicinity of a position where the tape bend portions of the right and left of fastener tapes are closely contacted when the fastener elements are engaged.

3. The fastener stringer for a concealed slide fastener according to claim 1, wherein the hollow weave portion extends throughout the element mounting portion.

4. The fastener stringer for a concealed slide fastener according to claim 1, wherein warp yarns disposed at a tape edge side of the element mounting portion are aligned in a tape top-back direction.

5. The fastener stringer for a concealed slide fastener according to claim 4, wherein warp yarns of the hollow weave portion disposed at a tape outer face side and a tape inner face side have 1/3 and 3/1 structures; and the warp yarns disposed at the tape edge side of the element mounting portion have a 2/2 structure.

6. The fastener stringer for a concealed slide fastener according to claim 1, wherein at least two overlaid film bodies are accommodated in the hollow weave portion.

7. The fastener stringer for a concealed slide fastener according to claim 6, wherein each film body has a thickness between 0.05 mm and 0.30 mm inclusive.

8. The fastener stringer for a concealed slide fastener according to claim 1, wherein the film body is made of at least one kind of materials being selected from groups of polyester resin, polypropylene resin, nylon resin and polycarbonate resin.

9. The fastener stringer for a concealed slide fastener according to claim 1, wherein the film body has a winding shape in a wavelike fashion along a tape longitudinal direction.

10. The fastener stringer for a concealed slide fastener according to claim 1, wherein warp yarns and weft yarns forming the fastener tape are between 167 dtex and 330 dtex inclusive and 4.5 dtex/f and 10.0 dtex/f inclusive.

11. The fastener stringer for a concealed slide fastener according to claim 1, wherein the fastener element is sewn to the fastener tape in double-chain stitching with the sewing thread; and the needle thread of the sewing thread is between 840 dtex and 990 dtex inclusive and a looper thread of the sewing thread is between 234 dtex and 705 dtex inclusive.

* * * * *

UNITED STATES PATENT AND TRADEMARK OFFICE

CERTIFICATE OF CORRECTION

PATENT NO. : 9,089,187 B2
APPLICATION NO. : 13/394830
DATED : July 28, 2015
INVENTOR(S) : Akira Takano et al.

It is certified that error appears in the above-identified patent and that said Letters Patent is hereby corrected as shown below:

Specification

In column 10, line 32, delete “mM” and insert -- mm --, therefor.

Claims

In column 17, line 9, in claim 1, after “sewn” delete “together”.

Signed and Sealed this
Twenty-ninth Day of December, 2015

Michelle K. Lee

Michelle K. Lee
*Director of the United States Patent and Trademark Office*